United States Patent [19]

Winslow

[11] 4,423,652

[45] Jan. 3, 1984

[54] POTATO CENTERING DEVICE

[75] Inventor: Elden D. Winslow, Caldwell, Id.

[73] Assignee: J. R. Simplot Company, Boise, Id.

[21] Appl. No.: 260,971

[22] Filed: May 6, 1981

[51] Int. Cl.[3] ..... B26D 1/03

[52] U.S. Cl. ..... 83/24; 83/98; 83/107; 83/402; 83/404.3

[58] Field of Search ..... 83/24, 98, 99, 105, 83/107, 402, 13, 404.3

[56] References Cited

U.S. PATENT DOCUMENTS

| | | | |
|---|---|---|---|
| 3,109,468 | 11/1963 | Lamb et al. . | |
| 3,116,772 | 1/1964 | Lamb et al. . | |
| 3,208,625 | 10/1963 | Lamb et al. . | |
| 4,082,024 | 4/1978 | Hodges et al. . | |
| 4,135,002 | 1/1979 | Hodges et al. . | |
| 4,372,184 | 2/1983 | Fisher | 83/98 |

FOREIGN PATENT DOCUMENTS

| | | | |
|---|---|---|---|
| 842420 | 6/1952 | Fed. Rep. of Germany | 83/402 |

*Primary Examiner*—James M. Meister

*Attorney, Agent, or Firm*—Fulwider, Patton, Rieber, Lee & Utecht

[57] ABSTRACT

A centering device is provided for centering a potato with respect to a propelling hydraulic fluid flow stream which carries the potato into cutting engagement with knife elements of a cutting assembly positioned along the flow stream. The device comprises an elongated tube at the upstream end of the cutting assembly shaped to define a linear flow path of generally circular cross-section and oriented for continuously accelerating the hydraulic fluid. This acceleration results in the fluid having a slightly higher velocity than the potato throughout the length of the tube to create, when the potato is displaced from a centered position, fluid velocity and pressure differentials on opposite sides of the potato tending to return the potato to the centered position.

19 Claims, 5 Drawing Figures

POTATO CENTERING DEVICE

BACKGROUND OF THE INVENTION

This invention relates to improvements in so-called hydraulic cutting assemblies wherein a vegetable product, such as a potato, is propelled by a fluid, such as water, into cutting engagement with knife elements positioned along a fluid flow path. More specifically, this invention relates to a simplified and highly effective apparatus and method for accurately aligning and centering a potato prior to cutting engagement with the knife elements.

Hydraulic cutting assemblies in general are well known in the art, and typically comprise one or more cutting knife elements positioned along a flow path defined by an elongated tubular conduit. A pumping device is provided to entrain a vegetable product, such as a potato, with a propelling hydraulic fluid flow stream of relatively high velocity for flow through the conduit into cutting engagement with the knife elements. In production systems, the product is pumped one at a time in relatively rapid succession into and through the conduit with the kinetic energy imparted to the product by the flow stream serving to drive the product past the knife elements so that the product is severed into a plurality of smaller pieces at a relatively rapid production rate. The particular size and shape of the product pieces is, of course, dictated by the geometry of the knife elements, and these pieces are carried further by the flow stream into a discharge flow conduit which guides the pieces to subsequent, appropriate processing equipment for size grading, cooking, freezing, packaging, or the like. If desired, the knife elements can be designed to sever the product into pieces of more than one shape, with multiple discharge conduits being provided to carry the different pieces to different processing equipment. For examples of hydraulic cutting assemblies of this general type, see U.S. Pat. Nos. 3,109,468 and 3,116,772.

In such hydraulic cutting assemblies, major difficulties arise in the alignment and centering of the product, particularly potatoes, with respect to a longitudinal centerline of the hydraulic fluid flow path and the knife elements. More specifically, it is well recognized by the art that the potatoes tend to tumble and become disoriented with respect to the centerline as they are driven along the flow path by the propelling hydraulic fluid. This tumbling and disorientation is undesirably enhanced if the tubular conduit includes directional changes between the pumping device and the cutting elements, since such directional changes in the hydraulic flow result in increased flow turbulence. As a result, the potatoes normally wobble and bounce from side to side within the tubular conduit and impact the cutting elements in a random, nonaligned and noncentered fashion.

To overcome this problem encountered in the prior art, a variety of relatively complex mechanical arrangements have been devised for physically centering and aligning the potato prior to engagement with the cutting elements. For example, as illustrated in the above-cited U.S. Pat. Nos. 3,109,468 and 3,116,772, symmetrically disposed resilient shoe assemblies have been proposed wherein the shoe assemblies are located along the flow path immediately upstream of the cutting element for physically capturing each potato and forcing the potato to align and center with respect to the longitudinal centerline of the flow path. Alternately, as depicted in U.S. Pat. No. 3,108,625, expansible tubular sleeves have been proposed wherein, similar to the resilient shoe assemblies, the sleeve physically captures each potato and forces it to align and center with respect to the longitudinal flow path centerline. Still further, as contemplated by U.S. Pat. Nos. 4,082,024 and 4,135,002, elongated spring-loaded converging walls have been used to achieve the same result, namely physical confinement of each potato for flow along the longitudinal flow path centerline. However, in all of these prior art devices, the mechanical construction is relatively complex, expensive, subject to periodic mechanical failure, and operates by physical impact with the potatoes which can result in damage to the cellular potato composition. Moreover, these mechanical devices restrict free flow of the potatoes into engagement with the cutting elements and thereby tend to absorb significant quantities of the hydraulic driving force. As a result, production rates are substantially reduced and larger propelling fluid velocities are required in order to maintain sufficient driving forces upon the potatoes to drive the potatoes past the cutting elements.

The present invention comprises a significant and remarkable improvement over the prior art by providing a simplified and inexpensive device and method for accurately centering and aligning potatoes with respect to a propelling hydraulic fluid flow stream by use of hydraulic forces such that the potatoes substantially avoid physical impact with the device.

SUMMARY OF THE INVENTION

In accordance with the invention, a potato centering device is provided in the form of a single, inexpensive elongated tube shaped and oriented to provide a variety of hydraulic forces which act upon a product, such as a potato, propelled through the tube to align and center the potato with respect to a longitudinal tube centerline. The hydraulic forces are obtained by controlling the flow of a propelling hydraulic fluid flow stream in a manner to create and maintain a differential between the velocities of the fluid and the potato which results in the creation of laterally directed forces acting upon the potato whenever the potato is displaced from an aligned and centered position to return the potato to the aligned and centered position. An important feature of the invention is the maintaining of this velocity differential for a sufficient period of time to permit the relatively massive potato to respond to the laterally directed forces and become aligned and centered prior to cutting engagement with knife elements at the downstream end of the centering device.

A preferred embodiment of the potato centering device of this invention comprises an elongated substantially linear tube defining a portion of an hydraulic flow path for passage of a potato propelled by a relatively high velocity hydraulic fluid flow stream. The tube is positioned immediately upstream of knife elements of an hydraulic cutting assembly wherein the tube and the knife elements are oriented about a common longitudinal centerline. The tube is shaped to define a generally circular cross section which progressively decreases in diameter toward the knife elements to cause continuous acceleration of the propelling flow stream and the potato toward the cutting assembly. The potato, however, accelerates at a rate slower than the flow stream resulting in a relative velocity differential which is maintained for the length of the tube. The higher velocity flow stream thereby moves past the lower velocity potato through an annular space between the potato and the tube.

When the potato is displaced from an aligned and centered position with respect to the centerline, the annular space between the potato and the tube becomes asymmetric. At the side of the potato closer to the tube, fluid flow is restricted and slowed, while a relatively unrestricted and thus more rapid fluid flow is permitted at the opposite side of the potato. This fluid velocity differential at opposite sides of the potato is accompanied by a fluid pressure differential which acts upon the potato to move the potato back toward the aligned and centered position.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
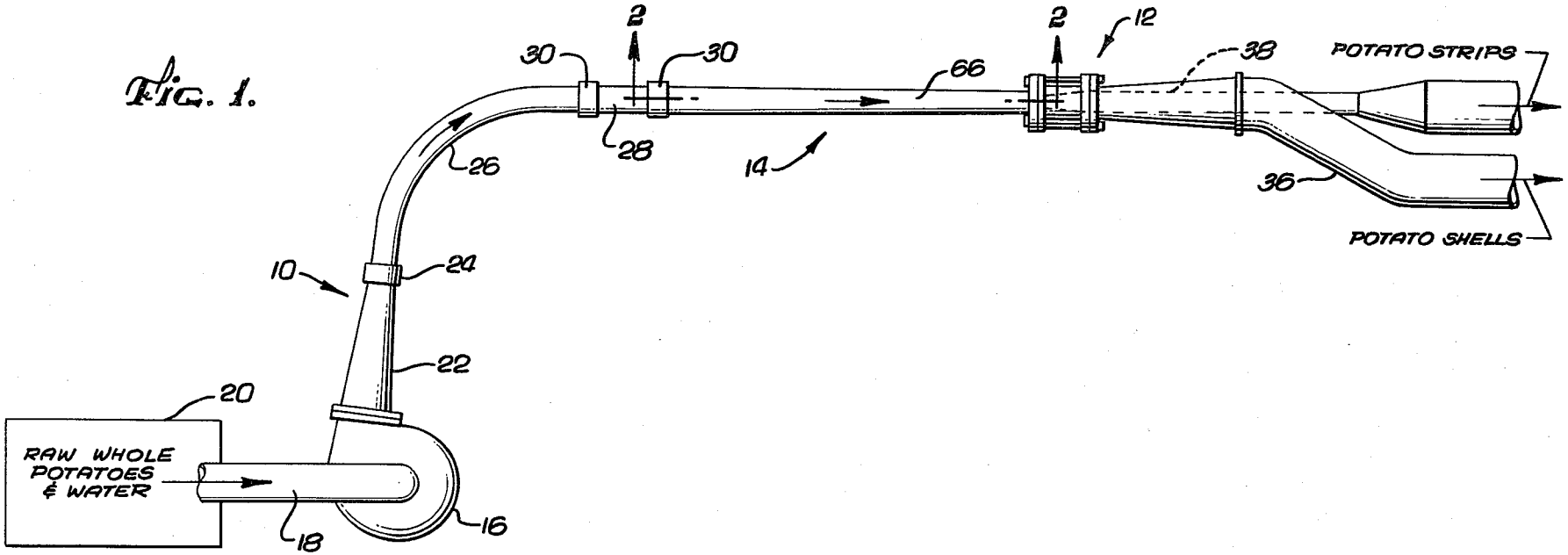
FIG. 1 is a side elevation view, somewhat in schematic form, illustrating an hydraulic cutting system including a centering device embodying the novel features of the present invention.

An hydraulic cutting system 10 is illustrated generally in FIG. 1 for dividing a product, such as a potato, into a plurality of smaller pieces of a desired size and shape. The cutting system 10 includes a cutting assembly, designated generally by the reference numeral 12, which supports a plurality of knife elements (not shown in FIG. 1) stationed along a tubular flow path through which the product is propelled one at a time. Importantly, according to the present invention, a centering device 14 of a simplified and inexpensive tubular construction is positioned immediately upstream of the cutting assembly 12 for accurate centering and longitudinal alignment of each one of the product along a centerline of the cutting assembly, whereby cut product pieces discharges from the cutting assembly have a highly consistent size and shape. This product centering and alignment is achieved by use of fluid velocity and pressure differentials to set up hydraulic forces acting upon the product for centering and alignment substantially without physical contact between the centering device 14 and the product.

The overall general construction and operation of the hydraulic cutting system 10 is relatively conventional in the art and is designed to propel any of a variety of products, such as vegetable products, and particularly potatoes, into cutting engagement with the knife elements of the cutting assembly 12. More specifically, and by way of background, the system 10 includes a so-called food pump 16 which is appropriately driven to draw in potatoes one at a time together with a propelling hydraulic fluid, such as water, through an inlet conduit 18 coupled to a supply reservoir 20 of potatoes and water. The pump 16 accelerates the water to a relatively high velocity and discharges the water and the potatoes through a pump outlet conduit 22. This high velocity water constitutes a propelling hydraulic fluid flow stream which carries and propels the potatoes one at a time into and through the outlet conduit. Conveniently, as described in U.S. Pat. Nos. 3,109,468 and 3,116,772, the outlet conduit 22 can be shaped to have a converging cross section such that the fluid and the potatoes are further accelerated, thereby longitudinally spacing or "singulating" the potatoes from each other within the propelling flow stream.

The outlet conduit 22 from the food pump 16 is commonly oriented to extend in a generally vertical direction for connection by an appropriate coupling 24 to a tubular turning bend 26. This turning bend 26 guides the hydraulic flow stream and the potatoes through a turning angle of about 90 degrees for flow in a generally horizontal direction through a tubular spacer 28 and the centering device 14 to the cutting assembly 12. Appropriate couplings 30 interconnect the spacer 28 between the turning bend 26 and the centering device 14 such that the outlet conduit 22, turning bend 26, spacer 28, and centering device 14 together define an hydraulic flow path 32 (FIG. 2) of relatively narrow cross section for flow of the propelling flow stream and each potato 34 (FIG. 2) into engagement with the cutting assembly 12.

The cutting assembly 12 normally includes a plurality of the knife elements each having a cutting edge presented in an upstream direction for cutting engagement with each potato 34. The potato 34 is propelled or driven by the hydraulic fluid flow stream with sufficient force into engagement with the knife elements such that the potato is driven on through the cutting assembly and exits therefrom as a plurality of smaller pieces of desired size and shape. The particular geometry of these potato pieces is, of course, related to the geometry of the knife elements, and it is not uncommon for these knife elements to be arranged to divide the potato into more than one type of smaller piece. For example, cutting assemblies are known wherein the knife elements remove longitudinal slabs from the exterior of the potato and divide the interior or core of the potato into a plurality of elongated strips for use as French fries. In this regard, the exterior pieces are guided by the propelling flow stream into an outer discharge conduit 36 and the interior pieces are guided by the flow stream into an inner discharge conduit 38 for separate supply to appropriate subsequent processing equipment (not shown) for grading, cooking, freezing, packaging, or the like.

Figure 3:
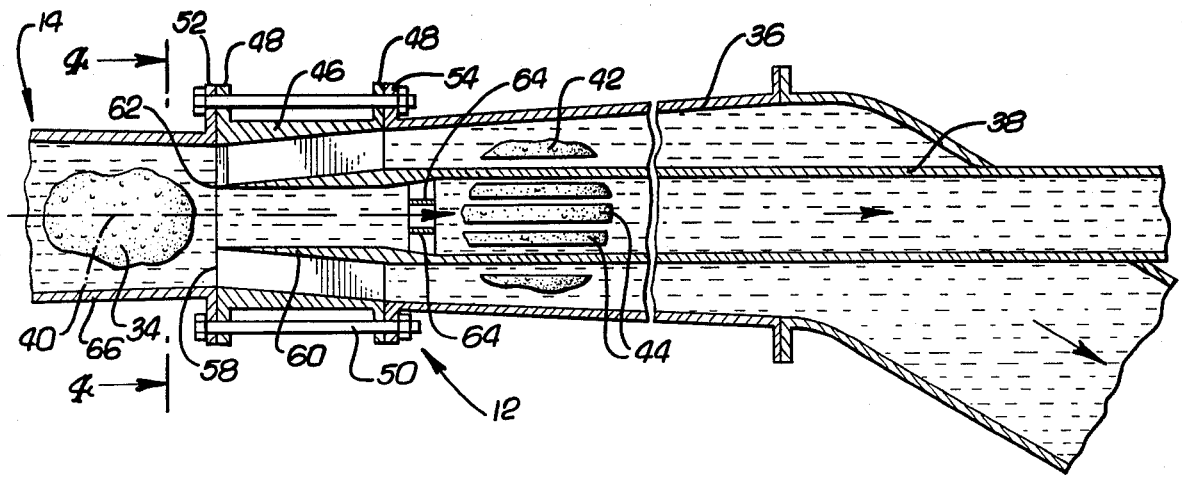
FIG. 3 is an enlarged fragmented vertical section taken generally on the line 3—3 of FIG. 2 and illustrating construction details of an exemplary hydraulic cutting assembly for use with the centering device.
Figure 4:
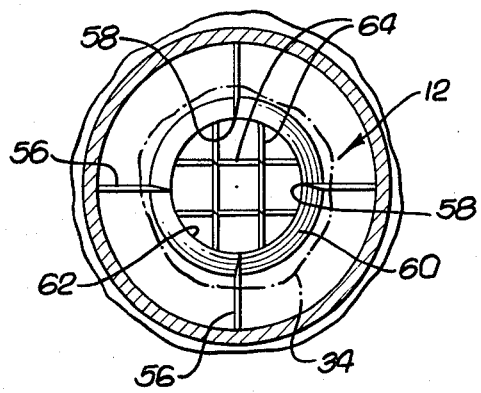
FIG. 4 is an enlarged fragmented vertical section taken generally on the line 4—4 of FIG. 3 and illustrating further construction details of the hydraulic cutting assembly.

With some cutting assemblies 12, it is highly desirable for each potato 34 to be closely and accurately aligned with a longitudinal centerline 40 of the cutting assembly knife elements. One such cutting assembly 12 is illustrated by way of example in FIGS. 2–4 wherein each potato 34 is divided into outer longitudinally extending shells 42 or arcuate cross section and an inner longitudinally extending core of a circular cross section which may be divided subsequently into elongated strips 44 for use as French fries. The outer shells 42 comprise a valuable market product for use, for example, as hors d'oeurves, whereby it is highly desirable to accurately center and align each potato 34 with the knife elements to insure consistency in the size and shape of the shells.

The illustrated cutting assembly 12 is shown and described in detail in copending application Ser. No. 238,007, filed Feb. 25, 1981, now U.S. Pat. No. 4,372,184 and assigned to the assignee herein. However, for sake of completeness of description and understanding of the centering device 14 of the present invention, the cutting assembly 12 includes an annular external housing 46 having peripheral flanges 48 at its opposite ends for connection by bolts 50 to mating flanges 52 and 54 at the adjacent ends of the centering device 14 and the outer discharge conduit 36. The housing supports a plurality of radially inwardly extending shell knives 56 each having a cutting edge 58 presented in an upstream direction. The radially inner edges of the shell knives 56 are supported by a cylindrical core knife 60 having a similarly presented cutting edge 62 and which is in turn supported at the upstream end of the inner discharge conduit 38. The shell knives 56 and the core knife 60 are oriented symmetrically about the centerline 40 to divide each potato into four outer shells 42 and a central cylindrical core, and this core is in turn divided into the strips 44 by a plurality of crisscrossing strip knives 64 positioned within the core knife 60.

The centering device 14 of this invention is provided for accurately aligning and centering each potato 34 with respect to the centerline 40 prior to cutting engagement of the potato with the knife elements. This aligning and centering is achieved by use of hydraulic forces which act upon each potato, in response to the position of the potato within the propelling flow stream, to move the potato toward an aligned and centered position substantially without physical contact of the potato with any structural surface and without substantial interruption of the propelling flow stream. In this manner, each potato is quickly, easily, and consistently aligned and centered at relatively high production rates without the use of complex mechanical centering devices.

According to a preferred embodiment of the invention, the centering device 14 comprises an elongated tube mounted between the spacer 28 and the cutting assembly 12 to define a linear portion of the flow path 32 immediately upstream of the cutting assembly 12. This tube is formed by a generally cylindrical wall 66 oriented about an elongated linear centerline coinciding with the centerline 40 of the cutting assembly. Importantly, as viewed in FIG. 2, the tube wall 66 defines an open flow area of generally circular cross section for passage of the propelling flow stream and each potato 34 wherein the open flow area progressively and gradually diminishes in cross section as the potato 34 approaches the cutting assembly 12.

The reducing cross sectional flow area provided by the tube wall 66 serves to accelerate the propelling flow stream and the potato continuously throughout the length of the centering device 14. This continuous acceleration immediately upstream of the cutting assembly 12 has been discovered to create hydraulic flow conditions which are highly satisfactory in aligning and centering the potato 34 with respect to the centerline 40 of the centering device 14 and the cutting assembly 12. More specifically, the front and rear ends 68 and 70 of a typical longitudinally elongated potato, such as a Russet Burbank potato, have been found to move to positions closely corresponding with the centerline 40 substantially without detectable physical contact between the potato and the tube wall 66.

Figure 2:
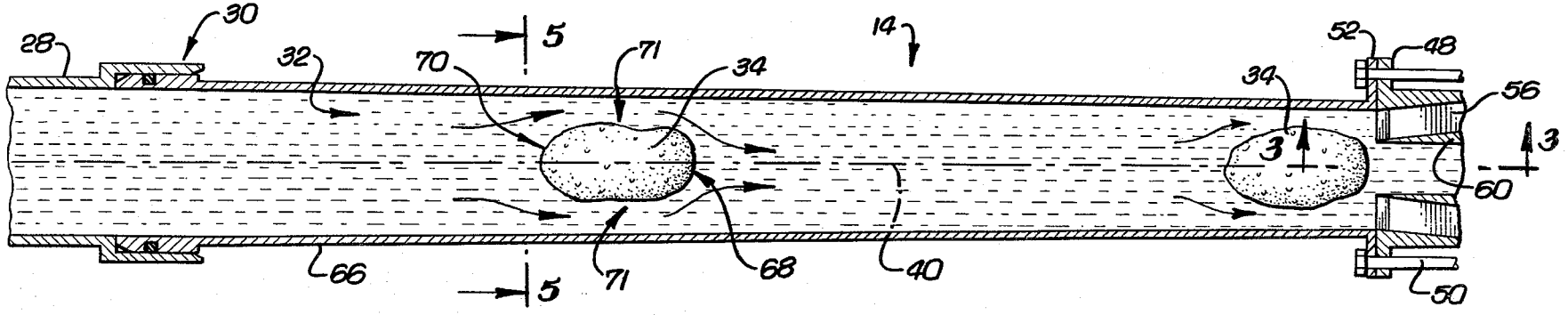
FIG. 2 is an enlarged fragmented horizontal section taken generally on the line 2—2 of FIG. 1 and illustrating a preferred geometry of the centering device.

While the precise nature of the hydraulic positioning forces acting upon the potato throughout the centering device are not completely understood, it is clear that the propelling flow stream is more quickly accelerated to a higher velocity than the potato. Thus, at any selected axial plane along the length of the centering device, the continuously accelerating flow stream has a velocity at least slightly greater than the velocity of the potato 34 which continuously and unsuccessfully attempts to accelerate to match the flow stream velocity. Accordingly, the higher velocity flow stream is required to pass the potato through a generally annular space 71 between the potato and the tube wall 66, as illustrated in FIGS. 2 and 5.

Figure 5:
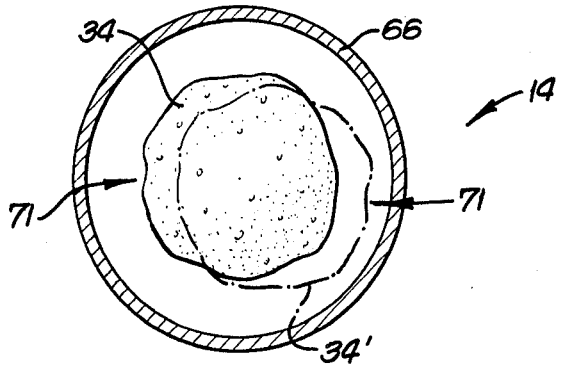
FIG. 5 is a fragmented vertical section taken generally on the line 5—5 of FIG. 2 and illustrating the application of hydraulic forces upon a product within the centering device.

In the event the potato 34 is not centered and aligned with respect to the centerline 40, as illustrated by the potato 34 outlined in dotted form in FIG. 5, then the annular space 71 between the potato and the tube wall 66 is not symmetric. Alternately stated, one side of the potato will be positioned closer to the tube wall 66 than the opposite side thereby defining fluid flow spaces of different sizes on opposite sides of the potato. When this occurs, it is believed that frictional resistance to fluid flow through the reduced size flow space created by the surfaces of the tube wall 66 and the potato tend to restrict and slow the velocity of the fluid therethrough, whereas reduced frictional resistance to fluid flow through the opposite larger flow space permits a relatively faster fluid velocity therethrough. The potato is thereby subjected to an instantaneous differential in fluid velocity at the opposite sides thereof to correspondingly subject the potato to an instantaneous differential in fluid pressure. Higher fluid pressure is associated with the lower velocity fluid resulting in a net force acting laterally upon the potato to urge the potato back toward an aligned and centered position. When the potato reaches this aligned and centered position, the annular space between the potato and the tube wall 66 becomes symmetric to reduce the fluid velocity and pressure differentials on opposite sides of the potato to zero. If the potato again wanders from the centerline 40, the continuously accelerating flow stream once again sets up the velocity and pressure differentials to urge the potato by hydraulic forces back to the centerline.

Additional hydraulic fluid velocity and pressure differentials are believed to be present which assist in the alignment and centering of each potato 34. More specifically, the hydraulic fluid flow stream passing through the elongated linear centering device 14 exhibits at least some characteristics of laminar fluid flow in that the velocity of the propelling flow stream at a selected axial plane is lower near the tube wall 66 as a result of frictional wall resistance than at locations away from the wall nearer the centerline 40. Accordingly, a natural velocity and corresponding pressure differential results wherein higher fluid pressures are present near the tube wall 66 and lower fluid pressures are present in the vicinity of the centerline 40. This additional pressure differential enhances the pressure differential created by displacement of the potato from the centerline 40 to help maintain the potato in an aligned and centered position.

The continuously accelerating flow stream also subjects the potato to a higher fluid velocity at the front end 68 than at the rear end 70. Accordingly, the front end 68 of the potato 34 is subjected to a slightly lower fluid pressure which tends to cause the front end 68 to move into alignment with the centerline 40. The remainder of the potato tends to follow this leading movement to move toward the aligned and centered position.

It is recognized that the length of the centering device 14 must be sufficient to permit the potato 34 to react to the hydraulic centering and aligning forces. While the specific required length of the centering device is functionally related to a variety of parameters, including, for example, the velocity of the flow stream the average mass of the potatoes and the relative sizes of the potatoes and the centering device, it has been discovered that relatively short centering device lengths of less than say about one foot are inadequate for satisfactory centering and aligning of potatoes in a typical hydraulic cutting system installation. Such short lengths do not permit the relatively massive potato to be subjected to the hydraulic forces for a sufficient time period to react to the forces and move to the desired centered and aligned position. A length for the centering device of at least about one and one-half feet appears to be required, with improved results being obtained as the device length is increased. A device length of about three to four feet, has been shown to provide highly satisfactory results. Further improvements in alignment and centering for device lengths greater than about six feet appear to be negligible.

In one working embodiment of the invention, by way of example, the cutting assembly 12 was constructed according to the description herein to divide each potato into the outer shells 42 and a central core from which the strips 44 were formed. Potatoes having lengths generally of from about 3.25 to about 5.5 inches and an outer diameter roughly equivalent to about 2.0 to about 2.5, with the substantial majority of the potatoes being about 2.0 to about 2.25 inches were supplied by the pump 16 to the upstream end of the centering device at a substantial velocity of about 15–20 feet per second.

The centering device 14 was shaped to have a length of about four feet and to converge from an inside diameter at its upstream end of about 3.25 inches to an inside diameter at its downstream end of about 2.25 inches. The velocity of the flow stream was accelerated by the centering device to a velocity of roughly about 30–40 feet per second at the downstream end of the device immediately prior to the cutting assembly.

In operation of the above example, the potatoes 34 were cut into strips 44 and shells 42 of highly consistent size and shape. An analysis of the outer shells revealed that the potatoes were being centered and aligned in a highly satisfactory manner before impacting the knife elements of the cutting assembly. More specifically, the shells 42 exhibited a high degree of uniformity in average thickness to indicate close centering of each potato along the centerline 40. Moreover, the shells exhibited little if any measurable deviation in thickness from end to end thereby indicating close angular alignment of each potato along the centerline. As a result of this centering and alignment, it was determined that about 95 percent of the shells were of acceptable quality for marketing purposes, with the substantial majority of these shells significantly exceeding minimum specifications for size, shape, and uniformity of cut.

A test similar to the working embodiment discussed above was conducted with a relatively short tube of converging cross section as the purported centering device. More specifically, a short tube about eight inches in length was positioned immediately upstream of the same cutting assembly and supplied with potatoes propelled by the pump 16 at a velocity of about 15–20 feet per second. This tube had upstream and downstream inner diameters of about 3.25 and 2.25 inches, respectively, and the potatoes had a length of about 3.25 to 5.5 inches and an outer diameter of roughly about 2.0 to as much as 2.5 inches.

The strips and shells cut from the potatoes wherein the short tube was used as a centering device did not exhibit an acceptable variation in size and shape for production purposes. In particular, the shells were analyzed and it was plainly evident that a substantially lower number of the shells were usable for marketing purposes. Only about 68 percent of the shells were of acceptable quality, and of these, a substantial majority exhibited marginally acceptable size, shape, and uniformity of cut.

Accordingly, the centering device 14 of this invention provides demonstrated improvements in the centering and aligning of potatoes propelled into cutting engagement with an hydraulic cutting assembly. These improvements appear, from test results, to be enhanced when the length of the potato is increased and/or when the outside diameter of the potato is increased to approach the inside diameter of the device 14. Therefore, the specific diameter and/or taper of the centering device 14 should be chosen according to the size of the potatoes while still accommodating passage of a few random potatoes which might be substantially oversized. However, as demonstrated by the data herein, potatoes which are slightly oversize have been shown to pass easily through the device and cutting assembly without substantial surface contact probably as a result of surface lubrication provided by the high velocity fluid and by some compression of the potato in response to fluid pressures. In addition, for best results, it is apparent that the potato should be accelerated prior to entering the centering device to a velocity at least approaching a velocity sufficient to drive the potato past the cutting assembly to minimize the potato acceleration required within the device, since rapid potato acceleration can result in increased fluid turbulence. Similarly, the velocities of the potato and the fluid should be maintained at a relatively low differential to avoid possible fluid turbulence.

Various modifications and improvements to the centering device and method of centering disclosed and described herein are believed to be apparent to one skilled in the art. Accordingly, no limitation upon the invention is intended, except as set forth in the appended claims.

What is claimed is:

1. In an hydraulic cutting system including an hydraulic flow path, a cutting assembly positioned along the flow path, and means for propelling a potato with a propelling liquid flow stream through the flow path into cutting engagement with the cutting assembly, a method of centering the potato within the flow path, comprising the steps of:

forming a portion of the flow path immediately upstream of the cutting assembly with an elongated and generally linear tube at least about one foot in length having a longitudinal centerline in substantial alignment with a centerline through the cutting assembly;

accelerating the flow stream for passage through the tube to a velocity greater than the velocity of the potato to create hydraulic forces which act upon the potato, when the potato is displaced from a centered position with respect to the centerline, to urge the potato to move back to the centered position; and maintaining a differential between the velocities of the flow stream and the potato throughout the length of the tube and for a sufficient period of time substantially until the potato moves into cutting engagement with the cutting assembly to permit the potato to react to the hydraulic centering forces for movement substantially to the centered position prior to engagement with the cutting assembly.

2. The method of claim 1 wherein said accelerating step comprises accelerating the flow stream substantially throughout the length of the tube.

3. The method of claim 2 wherein said accelerating step comprises forming the tube to have a progressively decreasing cross sectional area for passage of the flow stream and the potato from the upstream end of the tube to the cutting assembly.

4. The method of claim 2 wherein said maintaining step comprises forming the tube to have a length sufficient for residence of the potato within the tube for a sufficient period of time to permit the potato to react to the hydraulic centering forces for movement substantially to the centered position.

5. The method of claim 1 wherein said maintaining step comprises forming the tube to have a length of from about one foot to about six feet.

6. In an hydraulic cutting system including an hydraulic flow path, a cutting assembly positioned along the flow path, and means for propelling a potato with a propelling liquid flow stream through the flow path into cutting engagement with the cutting assembly, a method of centering the potato within the flow path, comprising the steps of:

forming a portion of the flow path immediately upstream of the cutting assembly with an elongated and generally linear tube at least about one foot in length and having a longitudinal centerline in substantial alignment with a centerline through the cutting assembly;

accelerating the flow stream and the potato to a substantial velocity at the upstream end of the linear flow path portion;

accelerating the flow stream at the upstream end of the linear flow path portion to a velocity greater than the potato velocity to create hyraulic forces which act upon the potato, when the potato is displaced from a centered position with respect to the centerline, to urge the potato to move back toward the centered position; and maintaining a differential between the velocities of the flow stream and the potato throughout the length of the tube and for a sufficient period of time substantially until the potato moves into cutting engagement with the cutting assembly to permit the potato to react to the hydraulic centering forces for movement substantially to the centered position prior to engagement with the cutting assembly.

7. The method of claim 6 wherein said step of accelerating the flow stream to a velocity greater than the potato comprises shaping the tube to have a cross-sectional flow area progressively decreasing toward the cutting assembly.

8. The method of claim 6 wherein said step of accelerating the flow stream to a velocity greater than the potato comprises continuously accelerating the flow stream through the length of the tube.

9. The method of claim 8 wherein said maintaining step comprises forming the tube to have a length of from about one foot to about six feet.

10. The method of claim 6 wherein said step of accelerating the flow stream and potato prior to the tube comprises accelerating the product to a velocity at least approaching a minimum velocity required for passage of the potato through the cutting assembly.

11. In an hydraulic cutting system including an hydraulic flow path, a cutting assembly positioned along the flow path, and means for propelling potatoes with a propelling liquid flow stream through the flow path into cutting engagement with the cutting assembly, a method of centering the potatoes within the flow path, comprising the steps of:

positioning an elongated and generally linear tube immediately upstream of the cutting assembly to define a generally linear flow path portion having a longitudinal centerline with a length of from about one foot to about six feet and aligned substantially with a centerline of the cutting assembly;

supplying the potatoes one at a time propelled by the flow stream at a substantial velocity to the upstream end of the tube for passage through the linear flow path portion;

accelerating the flow stream within the tube to a velocity greater than the velocity of the potatoes and maintaining the velocity differential throughout the length of the tube by forming the tube to have a progressively decreasing cross-sectional area for passage of the flow stream and the potatoes from the upstream end of the tube to the cutting assembly to create hydraulic forces which act upon each potato substantially until the potato moves into cutting engagement with the cutting assembly to urge the potato, when the potato is displaced from a centered position with respect to the centerline, back toward the centered position.

12. The method of claim 11 wherein each potato is supplied to the upstream end of the tube at a velocity at least approaching a minimum velocity required for passage of the potato through the cutting assembly.

13. In an hydraulic cutting system including a cutting assembly positioned along a flow path for dividing a potato propelled through the flow path by a propelling liquid flow stream into a plurality of smaller pieces, a device for centering the potato with respect to the flow path, comprising:

an elongated uninterrupted tube mounted to the upstream end of the cutting assembly, said tube defining a generally linear and longitudinally extending portion of the flow path at least about one foot in length and positioned in substantial alignment with a centerline through the cutting assembly for passage of the potato into cutting engagement with the cutting assembly, said tube being configured to have a cross-sectional flow area which progressively decreases in size from the upstream end of said tube to the cutting assembly for acceleration of the flow stream to a velocity greater than the velocity of the potato and for maintaining such velocity differential throughout the length of said tube substantially until the potato moves into cutting engagement with the cutting assembly to create hydraulic forces which act upon the potato, when the potato is displaced from a centered position with respect to the centerline, to urge the potato back toward the centered position, said tube having a length sufficient to permit the potato to react to the hydraulic centering forces for movement substantially to the centered position prior to cutting engagement with the cutting assembly.

14. The device of claim 13 including means for supplying the potato and the flow stream at a substantial velocity to the upstream end of said tube.

15. The device of claim 14 wherein said supplying means supplies the potato to the upstream end of said tube at a velocity at least approaching a minimum velocity required for passage of the potato through the cutting assembly.

16. The device of claim 13 wherein said tube has a length of at least about one foot to about six feet.

17. In an hydraulic cutting assembly including a cutting assembly positioned along a flow path for dividing a potato propelled through the flow path by a propelling liquid flow stream into a plurality of smaller pieces, a device for centering the potato with respect to the flow path, comprising:

an elongated uninterrupted tube mounted to the upstream end of the cutting assembly and defining a generally linear and longitudinally extending portion of the flow path at least about one foot in length and positioned in substantial alignment with a centerline of the cutting assembly for passage of the potato into cutting engagement with the cutting assembly; and means for supplying the potato and the flow stream at a substantial velocity to the upstream end of said tube;

said tube having a cross-sectional flow area decreasing progressively in size toward the cutting assembly for accelerating the flow stream to a velocity greater than the velocity of the potato and for maintaining such velocity differential throughout the length of said tube substantially until the potato moves into cutting engagement with the cutting assembly to create hydraulic forces which act upon the potato, when the potato is displaced from a centered position with respect to the centerline, to urge the potato back toward the centered position, said tube having a length sufficient to permit the potato to react to the hydraulic centering forces for movement substantially to the centered position prior to cutting engagement with the cutting assembly.

18. The device of claim 17 wherein said supplying means supplies the potato to the upstream end of said tube at a velocity at least approaching a minimum velocity required for passage of the potato through the cutting assembly.

19. The device of claim 17 wherein said tube has a length of at least about one foot to about six feet.

* * * * *